US008246300B2

(12) United States Patent
Shi et al.

(10) Patent No.: US 8,246,300 B2
(45) Date of Patent: Aug. 21, 2012

(54) VACUUM PUMP

(75) Inventors: Yongwei Shi, Chiba (JP); Yuji Takahashi, Chiba (JP)

(73) Assignee: Edwards Japan Limited (JP)

( * ) Notice: Subject to any disclaimer, the term of this patent is extended or adjusted under 35 U.S.C. 154(b) by 824 days.

(21) Appl. No.: 12/227,152

(22) PCT Filed: May 14, 2007

(86) PCT No.: PCT/JP2007/059846

§ 371 (c)(1),
(2), (4) Date: Mar. 20, 2009

(87) PCT Pub. No.: WO2007/135883

PCT Pub. Date: Nov. 29, 2007

(65) Prior Publication Data

US 2009/0257889 A1 Oct. 15, 2009

(30) Foreign Application Priority Data

May 19, 2006 (JP) ..... 2006-140186

(51) Int. Cl.
*F01D 1/36* (2006.01)

(52) U.S. Cl. ..... 415/199.5; 415/90; 415/55.1; 415/143

(58) Field of Classification Search ..... 415/199.5, 415/90, 143, 299.5, 52.1, 58.5
See application file for complete search history.

(56) References Cited

U.S. PATENT DOCUMENTS 5,158,426 A * 10/1992 Casaro et al. ..... 415/52.1
5,542,825 A * 8/1996 Perrillat-Amede et al. ..... 417/423.4
6,334,754 B1 * 1/2002 Kabasawa ..... 415/90
6,793,466 B2 * 9/2004 Miyamoto ..... 417/313
6,866,472 B2 * 3/2005 Okudera et al. ..... 415/90
7,824,153 B2 * 11/2010 Akimoto et al. ..... 415/191
2004/0076510 A1 * 4/2004 Favre-Felix et al. ..... 415/90

FOREIGN PATENT DOCUMENTS

DE 10357547 A1 7/2005
JP 2003-3987 A 1/2003
JP 2004-76623 A 3/2004
JP 2006-077713 3/2006
WO WO 2006/027961 A1 3/2006

OTHER PUBLICATIONS

Akimoto Takeshi, Kawanishi Shinji; English language abstract of Japanese Publication No. WO 2006027961 entitled "Fixed Vane of Turbo Molecular Pump," BOC Edwards Japan Ltd; Mar. 16, 2006.

(Continued)

*Primary Examiner* — Steven Loke
*Assistant Examiner* — David Goodwin

(57) ABSTRACT

The distance h between a base end face 12*ta* (12*tb*) of a stator-blade-wheel outer ring part 12*a* and the corresponding rotor-blade end face 4*aa* (4*ab*), is set at a value larger than the maximum deformation of the running rotor blade wheel 4*a* during the pump operation. The larger distance h keeps perfectly stator-rotor separation, while the outer ring part 12*a* of a stator blade wheel 12 goes, in assembling, into the rotor area on account of large shift of any half of stator blade wheels owing to the wide cutting width. It makes also easy stator blade wheel assembling of the pump, as it is allowable to arrange half stator blade wheels with some eccentricity.

3 Claims, 7 Drawing Sheets

OTHER PUBLICATIONS

Stanzel Joerg; English language abstract of Japanese Publicaton No. DE 10357547 entitled "Turbomolecular Pump Has Stator Discs Configured at Outer Edge to Form Greatest Possible Contact Surface with Distance Rings Which Space Out Discs," Pfeiffer Vacuum GmbH; Jul. 7, 2005.

Obayashi Tetsuo, Iguchi Masashi, Watanabe Mitsunori; English language abstract of Japanese Publication No. JP 2003003987 entitled "Molecular Pump," Osaka Vacuum Ltd.; Jan. 8, 2003.

Iguchi Masashi; English language abstract of Japanese Publication No. JP 2004076623 entitled "Method of Manufacturing Stationary Blade Stage of Turbo-Molecular Pump," Osaka Vacuum Ltd.; Mar. 11, 2004.

International Search Report of International Application No. PCT/JP2007/059846; Date of mailing of the International Search Report: Jul. 24, 2007.

Akimoto Takeshi, Kawanishi Shinji; English language abstract of JP Publication No. 2006-077713 entitled "Turbo-Molecular Pump Fixed Wing," BOC Edwards KK; Mar. 23, 2006.

Notification of Transmittal of Translation of the International Preliminary Report on Patentability of Internatinal Application No. PCT/JP2007/059846; Date of mailing: Jan. 22, 2009.

English translation of the International Preliminary Report on Patentability of International Application No. PCT/JP2007/059846.

* cited by examiner

[FIG.1]
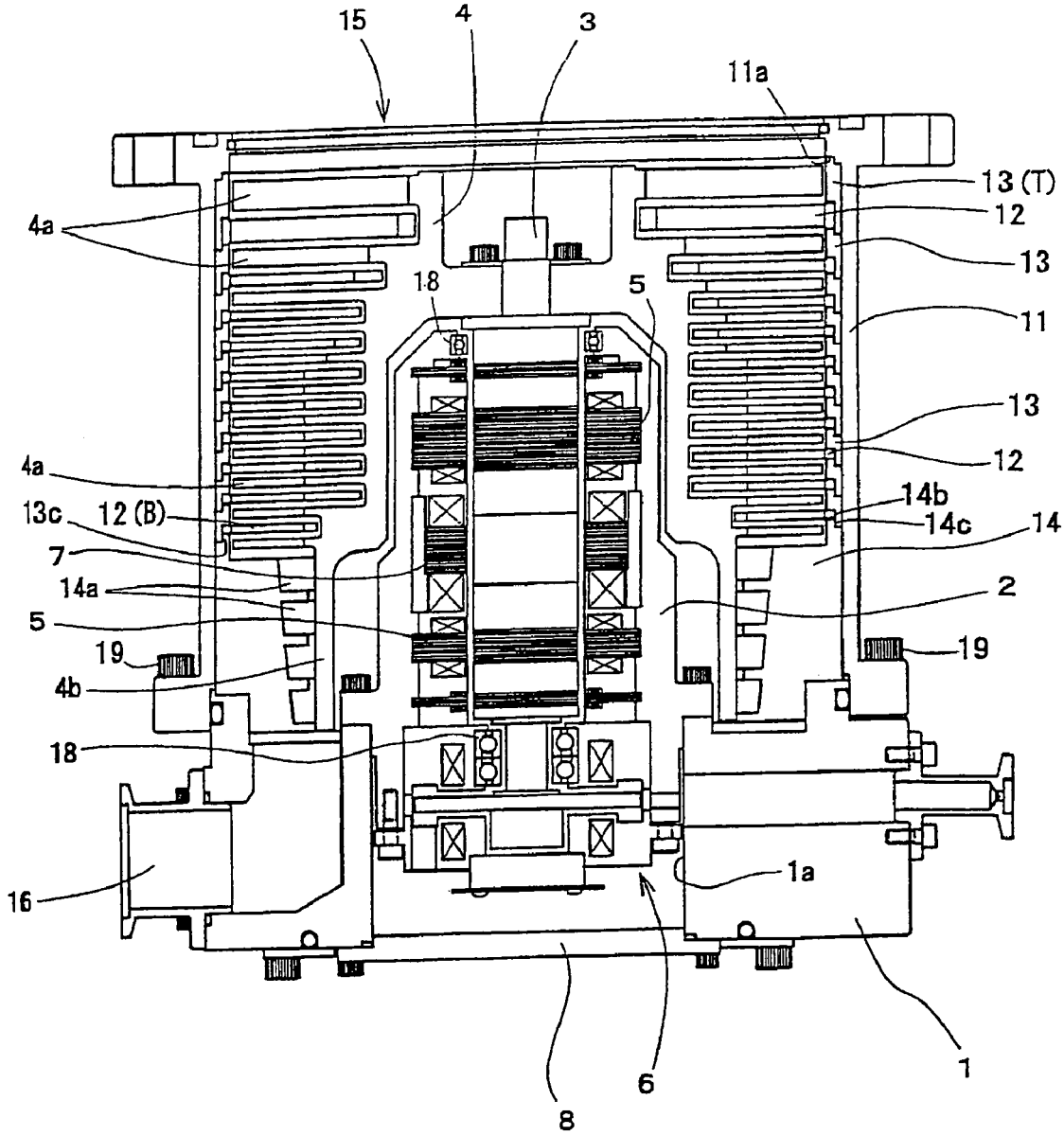

[FIG.2]
(a)
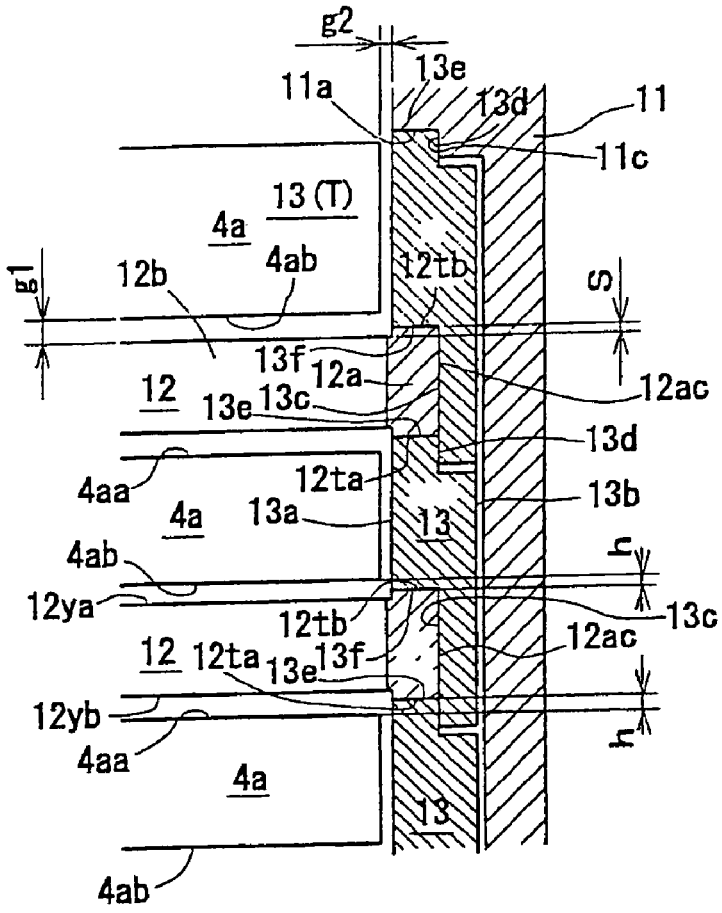
(b)
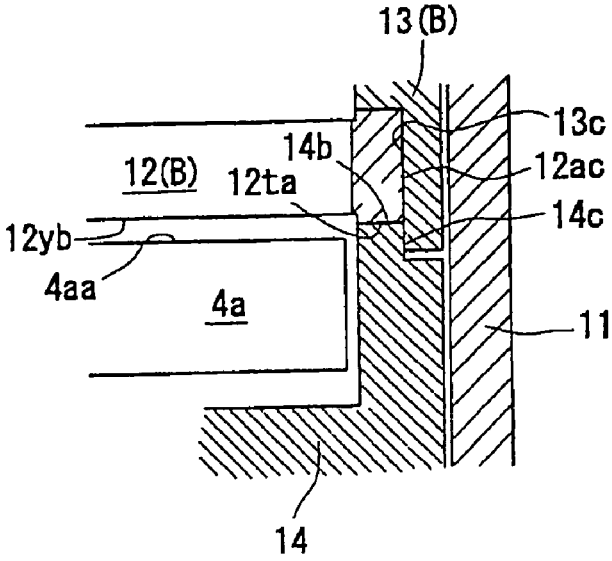

[FIG.3]
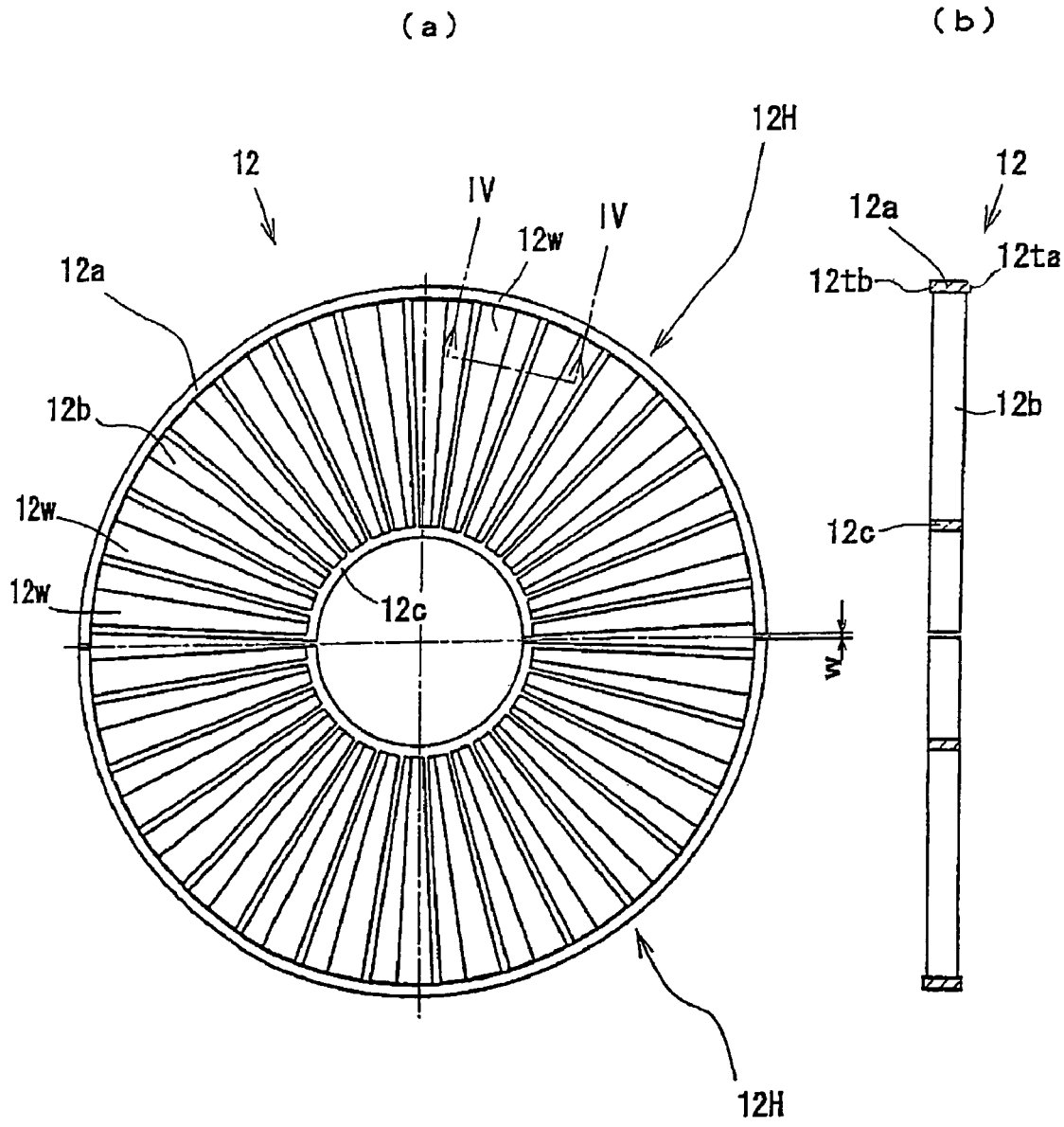

[FIG.4]
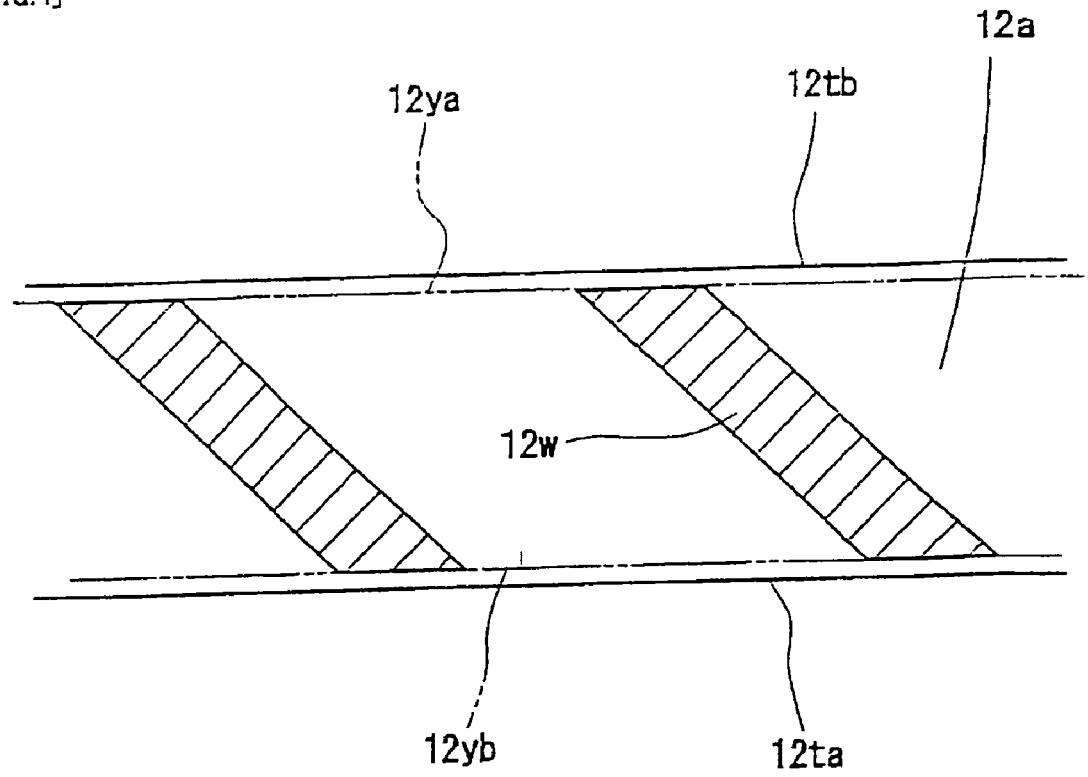
[FIG.5]
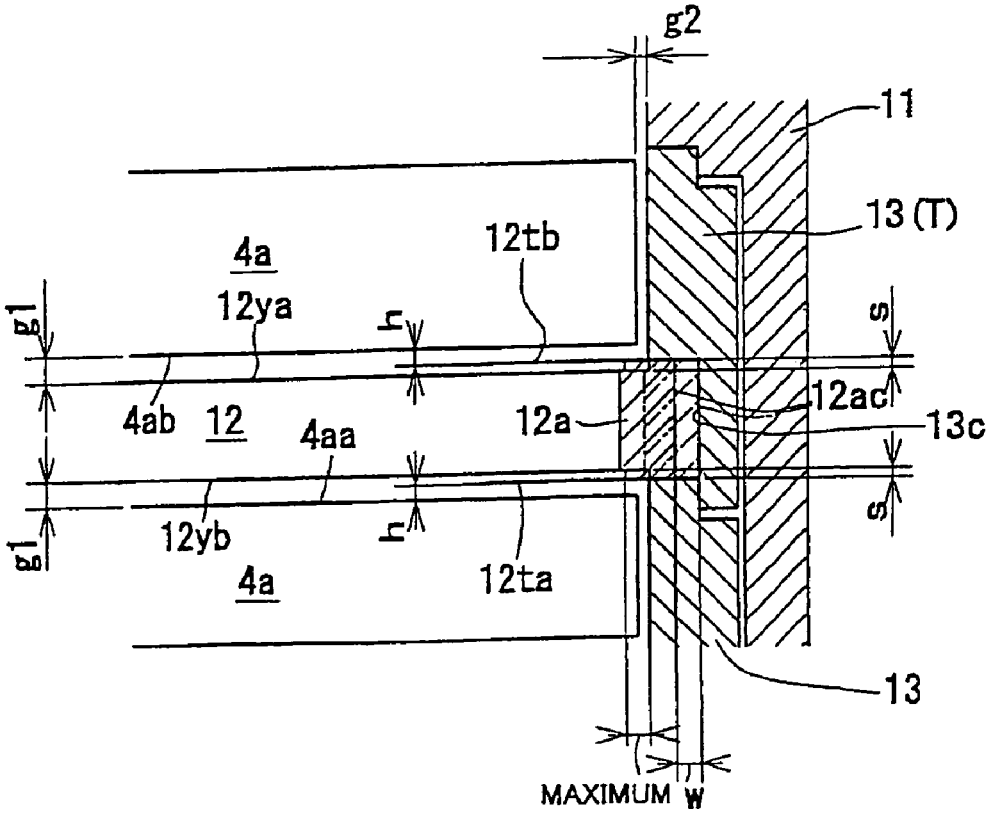

[FIG.6]
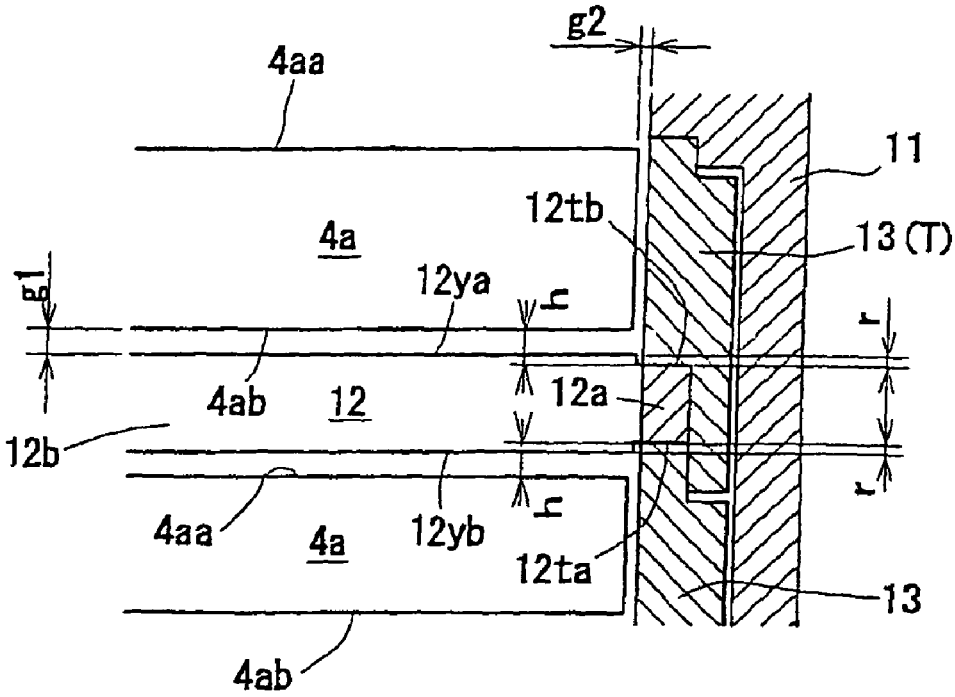

[FIG.7]
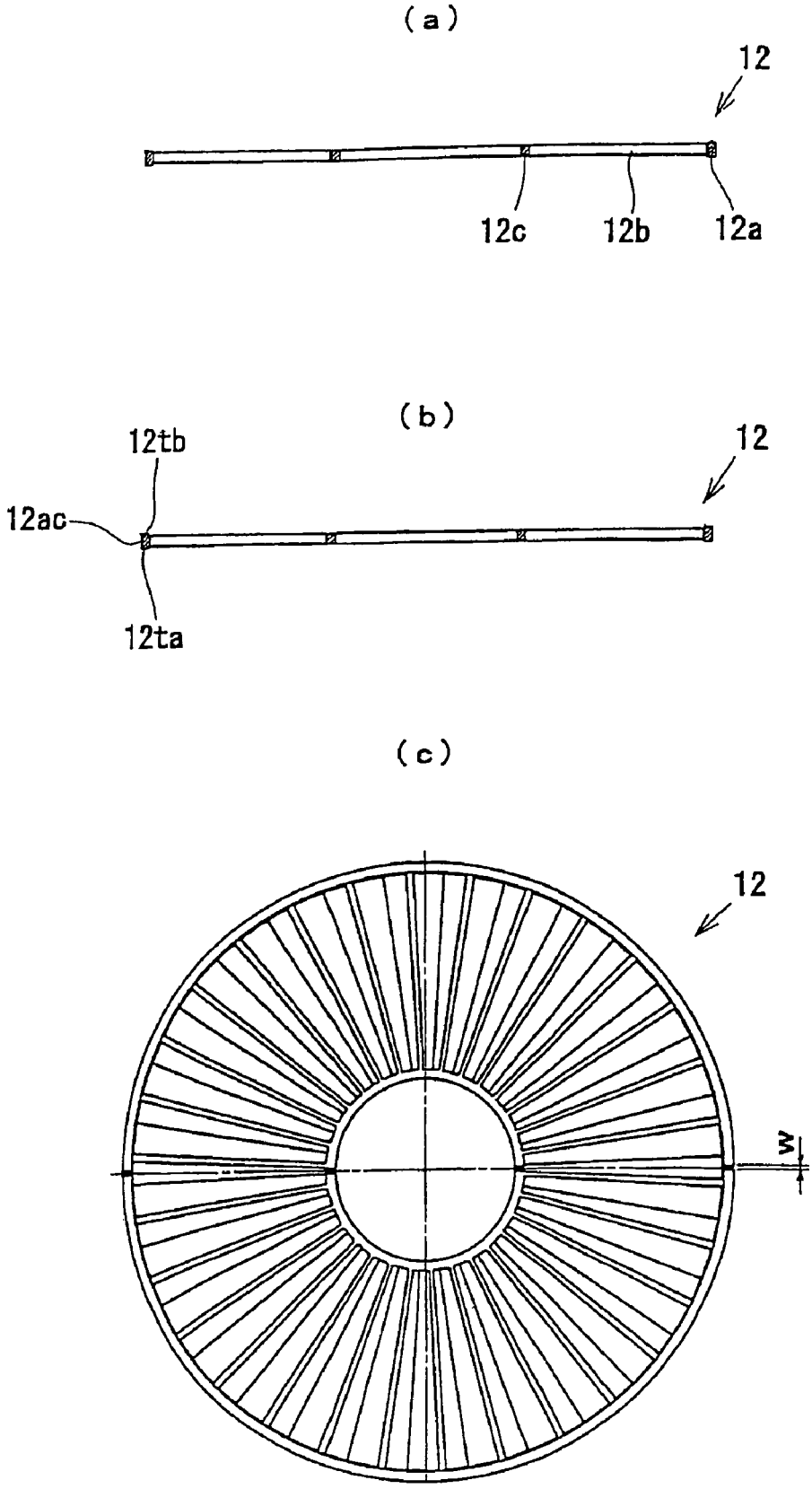

VACUUM PUMP

FIELD OF THE INVENTION

The present invention relates to a vacuum pump and, more particularly, to a vacuum pump having a turbo-molecular pump part.

BACKGROUND OF THE INVENTION

A vacuum pump having a turbo-molecular pump part as described in Japanese Patent Laid-Open No. 2003-269364 ("JP '364")(See scope of claims for patent, paragraph numbers 0021 and 0034, FIG. 2, FIG. 3, FIG. 4), for example, is known. JP '364 discloses a vacuum pump where spacers (50) are positioned between the stator blade wheels (11, 11) of upper and lower stages to separate (or create a gap between) the stator blade wheels (11, 11) at a prescribed distance. The spacers (50) have an outer circumferential part (50a) in contact with an inner circumferential part (1a) of a pump case (1). Similarly, each stator blade wheel (11) has an outer circumferential part (11a) that is also in contact with the inner circumferential part (1a) of the pump case (1). Alternatively, the outer circumferential part (11 a) of the stator blade wheel (11) may also be in contact with part of the spacers (50). JP '364 overcomes the problems in the prior art by using spacers (50) having a relatively simple geometry which results in cost reductions.

The stator blade wheel 11 of JP '364 includes a plurality of blades that are radially arranged and integrally connected via two inner and outer flanged parts (11-1, 11-2) having the shape of a semicircular arc. There is also a stator blade wheel of another construction without the outer flanged part (11-1). Though not described in the Detailed Description, the drawings show that the stator blade wheel (11) has a simple circular disc shape as viewed from the side, and the thickness of the two inner and outer flanged parts (11-1, 11-2) is the same as the thickness of a part where a blade is provided, and the whole provides flat upper and lower surfaces.

JP '364 does not describe the setting of the gap between the stator blade wheels (11, 11) in detail. However, the gap between the stator blade wheels (11, 11) is typically set to ensure that an appropriate gap between a rotor blade wheel (10), which is positioned between the stator blade wheels (11, 11), and the stator blade wheel (11) is sufficient. During manufacturing and assembly, small variations in the thickness of the individual spacers and stator blade wheels can accumulate. For this reason, it is important to appropriately control the spacing of all gaps between the rotor blade wheel. (10) and the stator blade wheel (11). Thus, the apparatus of JP '364 requires precise machining of the thickness of the spacers and stator blade wheels and elaborate assembly.

As described above, the stator blade wheel (11) has a plurality of blades that are radially arranged and integrally connected via the inner flanged part (11-2) having the shape of a semicircular arc or connected additionally by the outer flanged part (11-1). Each radial blade is relatively thin-walled and is susceptible to deformation by an external force. Therefore, without the outer flanged part (11-1), deformation is likely to occur from compression between the spacers during pump assembly and it is difficult to ensure that the gap between the stator blade wheels is set at a prescribed value.

While attaching the outer flanged part (11-1) to the stator blade wheel (11) eliminates the problem of deformation, another problem arises with the accuracy of the spacer-abutment face of the outer flanged part. In general, because of the complex shape of the radial blade part, the stator blade wheel is formed from an aluminum alloy using precision casting and the like. Precision casting and other forming methods cause the upper and lower spacer-abutment faces of the outer flanged part to be rough, and the thickness accuracy is insufficient. Therefore, the spacer abutment face is unable to perform its function. For this reason, finish machining by cutting, grinding and the like must be further performed to obtain a prescribed thickness and even contact between the upper and lower spacer-abutment faces.

Because JP '364 is not directed to setting the gap between the stator blade wheels, there is no explanation in the detailed description about setting the gap between the stator blade wheels and the section of the stator blade wheel in the drawings is drawn in a simple plate-like shape. That is, in JP '364 there is no description of a stator blade wheel in which the spacer-abutment face is easily finish machined.

FIGS. 8(*a*), 8(*b*) and 8(*c*) show conventional vacuum pumps having stator blade wheels suitable for finish machining the upper and lower spacer-abutment faces of the outer flanged part.

In FIG. 8(*a*), a plurality of rotor blade wheels 4*a* integrally formed on a rotor (not shown) and a plurality of stator blade wheels 12 provided within a cylinder of a pump case 11 are alternately arranged with a prescribed gap g1. The stator blade wheels 12 are held in a multi-stage manner by ring spacers 13 with a prescribed gap. An outer ring part 12*a* is present on the outer circumference of the stator blade wheel 12 and upper and lower end faces thereof provide base end faces 12*tb*, 12*ta*. The base end faces 12*tb*, 12*ta* abut against a lower surface 13*f* and an upper surface 13*e* of the ring spacer 13.

The outer ring part 12*a* is thicker than the blade part of the stator blade wheel 12 by an amount corresponding to a level difference s, which is sufficient for performing finish machining. Because of this level difference s, the finish machining of the base end faces 12*tb*, 12*ta* can be safely performed without contacting the finish machining tool with the blade part of the stator blade wheel. To further ensure that the finish machining tool does not contact the stator blade part, the small gap g1 between the rotor blade wheel 4*a* and the stator blade wheel 12 has been increased further by f, thus increasing the level difference s.

With this structure, the base end faces 12*tb*, 12*ta* are thus able to be finished with the same level of machining accuracy and finishing as the ring spacer 13 and, in addition, the thickness of the outer ring part 12*a* can also be machined with good accuracy. As a result of the spacer 13 and stator blade wheel 12 having precisely machined base end faces, the axis line gap g1 between the rotor blade wheel 4*a* and the stator blade wheel 12 can be set at an appropriate value.

An outer circumferential face 12*ac* of the outer ring part of the stator blade wheel 12 abuts against an inner cylinder face 11*b* of the pump case 11 and fixes the radial position of the stator blade wheel 12, as a result, the radial gap g2 between the rotor blade wheel 4*a* and the stator blade wheel 12 is set at an appropriate value.

The smaller the axis line direction gap g1 and radial gap g2 between the rotor blade wheel 4*a* and the stator blade wheel 12, the better the pump performance. However, an appropriate axis line direction gap g1 and an appropriate radial gap g2 are necessary in order to prevent: 1) the rotor blade wheel 4*a* from being instantaneously deformed during the rotation of the rotor blade wheel 4*a* due to gas and the like entering the pump and the rotor blade wheel 4*a*; and 2) the stator blade wheel 12 from contacting the rotor blade wheel 4*a* due to machining errors of the rotor blade wheel 4*a*, stator blade wheel 12 and spacer 13, pump assembly errors and the like.

In a vacuum pump of this kind, as described also in JP '364, the stator blade wheel 12 is divided into two semiannular parts in order to permit pump assembly. The annular stator blade wheel is cut into halves using a tool. As a result of this cutting, the stator blade wheel is ground by a cutting width w that substantially corresponds to the width of the tool and only a linear portion having the cut width w is cut from the circular middle part (see FIG. 3).

On the other hand, in a standard form, each stator blade wheel 12 obtained by combining two semiannular parts abuts snugly against the inner cylinder face 11*b* of the pump case as shown in FIG. 8(*a*). However, because a gap corresponding to the cutting width w is present between the two semiannular parts, in the pump assembling process, there is a possibility that due to a radial shift the stator blade wheel 12 departs a little from the inner cylinder face 11*b* of the pump case, thereby causing problems illustrated in FIGS. 8(*b*) and 8(*c*).

FIG. 8(*b*) shows that the stator blade wheel 12 shifts by an amount w' smaller than the cutting width w, with the result that the rotor blade wheel 4*a* and the stator-blade-wheel outer ring part 12*a* approach k'. In this condition, there is a possibility that the outer circumference of the rotor blade wheel 4*a* and the inner circumference of the stator-blade-wheel outer ring part 12*a* will come into radial contact with each other.

FIG. 8(*c*) shows that the stator blade wheel 12 shifts by the cutting width w and that the rotor blade wheel 4*a* and the stator-blade-wheel outer ring part 12*a* approach each other, with the result that a corner of the rotor blade wheel 4*a* interferes with a corner of the stator-blade-wheel outer ring part 12*a* by f in the axis line direction and by k in the radial direction, making assembly impossible.

To prevent the problems illustrated in FIGS. 8(*b*) and 8(*c*), it is required that the cutting width w of the stator blade wheel 12 be as small as possible. Such cutting has conventionally been carried out by wire electric discharge machining and the like using a wire that provides a fine cutting width. However, this wire electric discharge machining requires a long machining time and is costly. A practical cutting method that provides a small cutting width w and that is efficient is needed.

BRIEF SUMMARY OF THE INVENTION

To solve the above-described problems, the vacuum pump of the present invention comprises a cylindrical pump case, a rotor rotatably provided within a cylinder of the pump case, a plurality of rotor blade wheels formed in a multi-stage manner on an outer circumference of the rotor, a plurality of stator blade wheels provided within the cylinder of the pump case and arranged alternately with the rotor blade wheels in a multi-stage manner with a prescribed gap from the rotor blade wheels, and a plurality of ring spacers that are provided within the cylinder of the pump case and are each interposed between the stator blade wheels. Each of the rotor blade wheels is provided with upper and lower rotor-blade end faces, each of the stator blade wheels consists of a pair of half-annular stator blade wheels and has a blade part and an outer ring part, the blade part being provided with upper and lower stator-blade end faces, each of which faces a corresponding one of the rotor-blade end faces, the outer ring part being provided with upper and lower base end faces, each of which abuts against a corresponding one of cylindrical abutment end faces of the ring spacers. The distance between the base end face of the outer ring part and a supposed plane which includes the corresponding rotor-blade end face is set at a value larger than the range of deformation of the rotor blade wheel during pump operation.

In the above-described invention, the finish machining of the base end face is easy when it is ensured that the base end face of the outer ring part projects from the blade-part end face of the stator blade wheel.

To solve the above-described problems, the method of manufacturing a stator blade wheel of a vacuum pump of the present invention comprises forming an annular stator blade wheel having a blade part and an outer ring part, forming a base end face on an end face of the outer ring part, and setting the distance between the base end face of the outer ring part and a supposed plane including the rotor-blade end face corresponding to the base end face at a value larger than the range of deformation of the rotor blade wheel during the operation of a pump when the base end face abuts against a cylinder-abutment end face of a ring spacer of a vacuum pump, and machining/cutting the stator blade wheel, on which the base end face is formed, into a semiannular shape.

In the present invention, the word "corresponding" in the expression "the rotor-blade end face corresponding to the base end face" means that the blade-part end face of the stator blade wheel on the same side as the base end face (of the stator blade wheel) is opposed to the rotor-blade end face.

BRIEF DESCRIPTION OF THE DRAWINGS

FIG. 1 is a longitudinal sectional view showing an embodiment of the present invention;

FIGS. 2(*a*) and 2(*b*) are each partially enlarged sectional views of FIG. 1;

FIGS. 3(*a*) and 3(*b*) show a stator blade wheel in FIG. 1, FIG. 3(*a*) being a plan view and FIG. 3(*b*) being a sectional view;

FIG. 4 is a IV-IV enlarged sectional view in FIG. 3(*a*);

FIG. 5 is a sectional view showing a case where the stator blade wheel is set out of setting alignment in FIG. 2(*b*);

FIG. 6 is a partially enlarged sectional view showing another embodiment of the present invention;

FIGS. 7(*a*), 7(*b*) and 7(*c*) are explanatory diagrams showing a method manufacturing the stator blade wheel of the present invention.

DESCRIPTION OF SYMBOLS

Figure 8A:
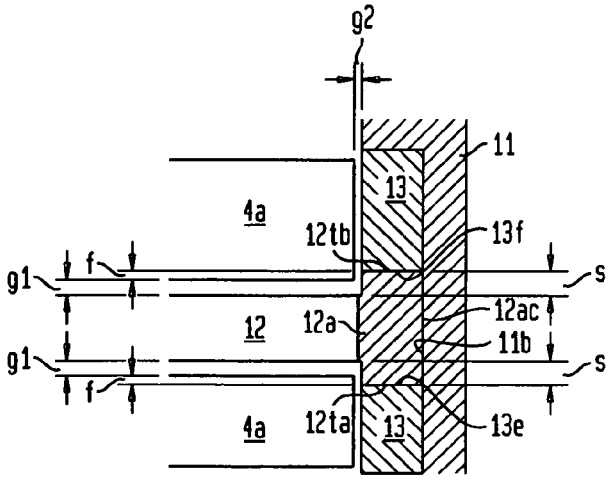
FIGS. 8(*a*), 8(*b*) and 8(*c*) are explanatory diagrams to explain problems in conventional vacuum pumps.
Figure 8B:
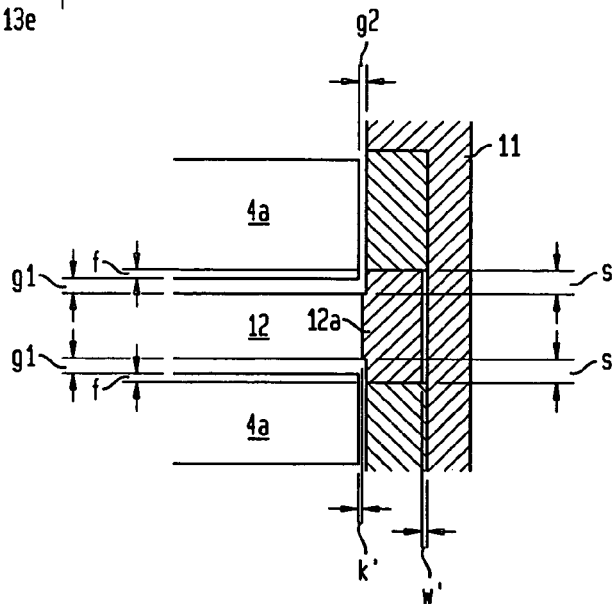
Figure 8C:
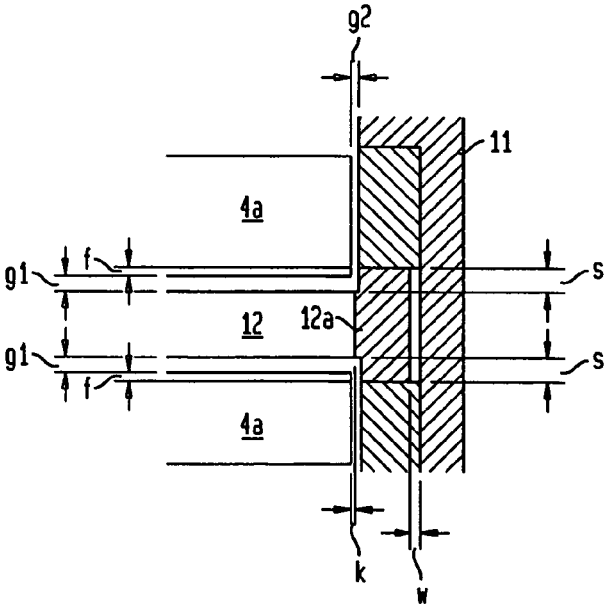

1 Base
1*a* Socket for receiving column
2 Stator column
3 Rotor shaft
4 Rotor
4*a* Rotor blade wheel
4*aa*, 4*ab* rotor-blade end face
4*b* Skirt part
5 Radial magnetic bearing
6 Axial magnetic bearing
7 Motor
8 Bottom lid
9 Pump case
11*a* Spacer-abutment end face
11*c* Spacer-abutment cylindrical face
12 Stator blade wheel
12*a* Outer ring part
12*ta*, 12*tb* Base end face
12*ac* Outer circumferential face of outer ring part
12*b* Blade part
12*ya*, 12*yb* Blade-part end face of stator blade wheel
12*c* Inner ring part

12*w* Blade of stator blade wheel
12H Semicircular annular stator blade wheel
12(B) Bottommost stator blade wheel
Ring spacer
13*a* Inner cylindrical face
13*b* Outer cylindrical face
13*c* second inner cylindrical face
13*d* Stepped outer cylindrical part
13*e* Upper cylinder-abutment end face
13*f* Middle cylinder-abutment end face
13(B) Bottommost ring spacer
13(T) Topmost ring spacer
14 Screw stator
14*a* Screw groove
14*b* Stator blade wheel abutment end face
14*c* Spacer-abutment cylindrical face
15 Suction port
16 Exhaust port
18 Protective bearing
19 Bolt
g1 Axis line direction gap between stator blade wheel 12 and rotor blade wheel 4*a*
g2 Radial gap between rotor blade wheel 4*a* of rotor 4 and ring spacer 13
h Distance between a base end face 12*ta* (12*tb*) of outer ring part 12*a* and the corresponding rotor-blade end face 4*aa* (4*ab*).
s Level difference between blade-part end face 12*ya* (12*yb*) of stator blade wheel and base end face 12*tb* (12*ta*)
w cutting width
r Amount of depression of base end face 12*ta* (12*tb*) from blade-part end face of stator blade wheel 12*yb* (12*ya*)

DETAILED DESCRIPTION OF THE INVENTION

The present invention provides a vacuum pump, which solves the above-described problems, and in which stator blade wheels and rotor blade wheels do not interfere with each other using lower-cost but wider-width cutting or grinding for cutting the stator blade wheels in half. The invention overcomes the problems using expensive but narrower cutting-width wire electric discharge machining.

In the present invention, the word "distance", in the expression "the distance between the base end face of the outer ring part and a supposed corresponding plane including the rotor-blade end face", means the distance h between the base end face 12*ta*, 12*tb* and a supposed plane, that includes the rotor-blade end face 4*aa*, 4*ab* and is extended to where the base end face 12*ta*, 12*tb* faces, i.e., the distance in the direction of the pump axis line.

In the present invention, the phrase "to be set at a value larger than the range of deformation of the rotor blade wheel during the operation of a pump" means to be set at a value larger than the range of deformation in which machining errors of the rotor blade wheel 4*a*, the stator blade wheel 12 and the spacer 13 and pump assembling errors and the like are added to an experimentally or theoretically estimated amount of deformation if the rotor blade wheel 4*a* is instantaneously deformed due to gas and the like entering the pump, positional shifts due to machining errors of the rotor blade wheel 4*a*.

In the present invention, "machining" includes grinding in addition to machining.

In the present invention, the distance h from the base end face 12*ta* (12*tb*) of the stationary-base outer ring part 12*a* (see FIG. 5) to a supposed plane including the corresponding base end face 4*aa* (4*ab*) is set at a value larger than the range of deformation of the rotor blade wheel 4*a* during pump operation. Therefore, even in a case where during an assembling process due to a large cutting width w of a stator blade wheel 12, the stator blade wheel 12 shifts radially with respect to a ring spacer 13 and an outer ring part 12*a* protrudes to a space between the rotor blade wheel 4*a* and the stator blade wheel 12, there is no possibility that the outer ring part 12*a* of the stator blade wheel 12 might collide with the rotor blade wheel 4*a* during operation. Because the outer ring part 12*a* and the rotor blade wheel 4*a* do not interfere with each other even when the cutting width w of the stator blade wheel 12 is large, the stator blade wheel 12 can be economically cut into a semiannular shape by cutting using a cutter etc. and grinding without using expensive wire electric discharge machining. Moreover, pump assembly becomes easy. The pump performance can also be maintained.

An embodiment of the present invention will be described below with reference to FIG. 1 to FIGS. 7(*a*), 7(*b*) and 7(*c*). FIG. 1 is a longitudinal sectional view showing an embodiment of the present invention. FIGS. 2*a* and 2*b* are each partially enlarged sectional views of FIG. 1. FIGS. 3(*a*) and 3(*b*) show a stator blade wheel in FIG. 1, FIG. 3(*a*) being a plan view and FIG. 3(*b*) being a sectional view. FIG. 4 is a IV-IV enlarged sectional view in FIG. 3(*a*). FIG. 5 is a sectional view showing a case where the stator blade wheel is set out of setting alignment in FIG. 2(*b*). FIG. 6 is a partially enlarged sectional view showing another embodiment of the present invention. FIGS. 7(*a*), 7(*b*) and 7(*c*) are explanatory diagrams showing a method manufacturing the stator blade wheel of the present invention.

In FIG. 1, reference numeral 1 denotes a base, reference numeral 2 denotes a stator column, reference numeral 3 denotes a rotor shaft, reference numeral 4 denotes a rotor, reference numeral 5 denotes a radial magnetic bearing, reference numeral 6 denotes an axial magnetic bearing, and reference numeral 7 denotes a motor.

A socket for receiving column 1*a* is provided in the middle of the above-described base 1. A lower portion of the cylindrical stator column 2 is inserted from the upper side into the socket 1*a* and fitted thereto and the cylindrical stator column 2 is bolted and provided in a standing manner in the middle of the base 1 on the upper side thereof. The socket 1*a* is stoppered with a bottom lid 8 attached to a bottom surface of the base 1.

The above-described rotor shaft 3 provides a connection at an upper portion thereof to integrally hold the above-described rotor 4, and is rotatably inserted into an inner cylinder of the stator column 2 while keeping a gap.

That is, between the rotor shaft 3 and the stator column 2 there are positioned the above-described radial magnetic bearing 5 and axial magnetic bearing 6, and in order to ensure that the above-described stator column 2 holds the rotor shaft 3 so as to be rotatable, the radial magnetic bearing 5 radially holds the rotor shaft 3 and the axial magnetic bearing 6 holds the rotor shaft 3 in the axis line direction.

Between the rotor shaft 3 and the stator column 2 there is positioned the above-described motor 7. This motor 7 rotatably drives the rotor shaft 3 and the rotor 4 with respect to the above-described stator column 2.

On an upper outer circumference of the above-described rotor 4, a plurality of rotor blade wheels 4*a*, 4*a*, . . . are formed in a multi-stage manner.

There are small gaps between the two magnetic bearings 5, 6 and a member on the stator column 2 side and a member on the rotor shaft 3 side of the motor 7. The control of each gap of the magnetic bearings 5, 6 enables the rotor shaft 3 and the rotor 4 to be stably held in the space, and the rotor shaft 3 and the rotor 4 are rotated at high speeds by the motor 7.

Reference numeral 11 denotes a pump case, reference numeral 12, 12, . . . denotes a plurality of stator blade wheels, and reference numeral 13, 13, . . . denotes a plurality of ring spacers.

The above-described pump case 11, which is cylindrical, is attached above the above-described base 1. The pump case 11 houses the stator column 2 within the cylinder thereof and houses the rotor shaft 3 and the rotor 4 so as to be rotatable.

The above-described stator blade wheels 12, 12, . . . are superposed alternately with the plurality of rotor blade wheels 4*a*, 4*a*, . . . of the above-described rotor 4 with a prescribed gap, and a turbo-molecular pump part is formed by the rotor blade wheels 4*a*, 4*a*, . . . and the stator blade wheels 12, 12, . . . .

The above-described ring spacers 13, 13, . . . are axially provided in a superimposed manner in the upper portion within the cylinder of the above-described pump case 11 and are each interposed between the above-described stator blade wheels 12, 12.

Reference numeral 14 denotes a screw stator that is provided on an inner surface of the pump case 11 between the base 1 and the above-described stator blade wheels 12, 12, . . . and a screw groove 14*a* is formed on an inner circumferential face of the screw stator 14. The screw groove 14*a* of this screw stator 14 faces an outer circumferential face of a thin-walled, cylindrical skirt part 4*b* of a lower portion of the above-described rotor 4 in proximity to the outer circumferential face and a screw-groove pump part is formed by the screw groove 14*a* and the skirt part 4*b*.

Reference numeral 15 denotes a suction port of the pump and reference numeral 16 denotes an exhaust port. The suction port 15 is provided in an upper portion of the pump and the exhaust port 16 is provided within the base 1.

Reference numeral 18 denotes a protective bearing provided between the stator column 2 and the rotor shaft 3. This protective bearing 18 is intended for preventing the contact between the magnetic bearings 5, 6 and each stator column side and rotor shaft side of the motor 7 when it is impossible to control the magnetic bearings in the case of power failures, circuit abnormalities and the like.

Next, details of the turbo-molecular pump part, which is one of the features of the present invention, will be described with reference to FIGS. 2(*a*) and 2(*b*) to FIGS. 7(*a*), 7(*b*) and 7(*c*).

In FIG. 2(*a*), rotor-blade end faces 4*aa*, 4*ab* are formed on upper and lower surfaces of the above-described rotor blade wheel 4*a*. The above-described rotor-blade end faces 4*aa* (4*ab*) provide a supposed plane orthogonal to a rotor axis line that envelopes top surfaces (bottom surfaces) of a plurality of radial blades (not shown) formed in the rotor blade wheel 4*a*. A blade-part end face 12*ya* (12*yb*) of the stator blade wheel provides a supposed plane orthogonal to a rotor axis line that envelopes top surfaces (bottom surfaces) of a plurality of radial blades 12*w*, 12*w*, . . . (see FIGS. 3 and 4) formed in the blade part 12*b* of the stator blade wheel.

In this embodiment, the ring spacer 13 has an inner cylindrical face 13*a*, an outer cylindrical face 13*b*, a second inner cylindrical face 13*c*, a stepped outer cylindrical part 13*d*, an upper cylinder-abutment end face 13*e*, and a middle cylinder-abutment end face 13*f*. The second inner cylindrical face 13*c* limits the stator-blade-wheel radial shift, which would be caused by the cutting width w.

The above-described inner cylindrical face 13*a* is formed in the upper part of the spacer, and the outer cylindrical face 13*b* is formed on substantially the whole outer circumference of the spacer in the rotor axis direction. The second inner cylindrical face 13*c*, which provides a diameter intermediate between diameters of the inner cylindrical face 13*a* and the outer cylindrical face 13*b*, is formed in the lower portion of the spacer, and the stepped outer cylindrical part 13*d*, which provides a diameter intermediate between the diameters of the inner cylindrical face 13*a* and the outer cylindrical face 13*b*, is formed in the upper portion of the spacer so as to engage with the second inner cylindrical face 13*c* of the ring spacer 13, which is adjacent above. The inner cylindrical face 13*a*, the outer cylindrical face 13*b*, the second inner cylindrical face 13*c*, and the stepped outer cylindrical part 13*d* are formed concentrically with each other.

The above-described upper cylinder-abutment end face 13*e* connects, at the highest top end of the spacer, the inner cylindrical face 13*a* and the stepped outer cylindrical part 13*d* together, and provides a cylinder-abutment end face that abuts against a lower-side base end face 12*ta* of the stator blade wheel 12, which is adjacent above. The above-described middle cylinder-abutment end face 13*f* connects the inner cylindrical face 13*a* and the second inner cylindrical face 13*c* together, and provides a cylinder-abutment end face that abuts against an upper-side base end face 12*ta* of the stator blade wheel 12, which is adjacent below.

The stator blade wheel 12 is such that an outer circumferential face 12*ac* of the outer ring part 12*a* thereof is fitted onto the second inner cylindrical face 13*c*, and the upper and lower base end faces 12*tb*, 12*ta* of the outer ring part 12*a* abut against the cylinder-abutment end faces 13*f*, 13*e*, respectively, as described above, and are fixed by being vertically sandwiched by the ring spacer 13. In this condition, the blade part 12*b* of the stator blade wheel 12 is positioned between the rotor blade wheels 4*a*, 4*a* above and below the blade part 12*b*.

Next, a description will be given of a rotor axis line direction and radial direction positioning mechanism of the plurality of stator blade wheels 12, 12, . . . and ring spacers 13, 13, . . . with reference to FIGS. 2(*a*) and 2(*b*).

In this embodiment, the upper cylinder-abutment end face 13*e* of a topmost spacer 13(T) abuts against a spacer-abutment end face 11*a* provided in an upper portion of the inner cylinder of the pump case 11 (FIG. 2(*a*)), and the lower-side base end face 12*ta* of a bottommost stator blade wheel 12(B) abuts against a stator blade wheel abutment end face 14*b* provided on an upper surface of the screw stator 14 (FIG. 2(*b*)). During pump assembly, with the stator blade wheels 12, 12, . . . and the ring spacers 13, 13, . . . on the screw stator alternately stacked, the pump case 11 is placed from above and the pump case 11 is fastened to the base 1 with a bolt 19 (see FIG. 1), whereby the positioning of all of the stator blade wheels 12, 12, . . . in the rotor axis line direction is performed and the gap between each stator blade wheel 12 and rotor blade wheel 4*a*, i.e., the distance between a blade-part end face 12*ya* (12*yb*) of the stator blade wheel and the rotor-blade end face 4*ab* (4*aa*), which are opposed to each other, is set at a prescribed value g1.

The stepped outer cylindrical part 13*d* of the topmost spacer 13(T) is fitted onto the spacer-abutment cylindrical face 11*c* adjacent to the above-described spacer-abutment end face 11*a*, and the outer circumferential face 12*ac* of the bottommost stator blade wheel 12(B) and the spacer-abutment cylindrical face 14*c* adjacent to the above-described stator blade wheel abutment end face 14*b* are fitted onto the second inner cylindrical face 13*c* of the bottommost ring spacer 13(B). Furthermore, the positioning of all of the stator blade wheels 12, 12, . . . and ring spacers 13, 13, . . . in the rotor radial direction results from the plurality of ring spacers 13, 13, . . . , which are vertically superposed, engage with each other at the second inner cylindrical face 13*c* and the stepped outer cylindrical part 13*d*. Consequently, the radial gap g2 between the rotor blade wheel 4*a* of the rotor 4 and the ring spacer 13 is set.

A more detailed description of the stator blade wheel 12 will be given below with reference to FIGS. 3(*a*) and 3(*b*) and FIG. 4.

As shown in FIGS. 3(*a*) and 3(*b*), the above-described stator blade wheel 12 has an inner ring part 12*c* in addition to the above-described outer ring part 12*a* and blade part 12*b*.

As already described, the above-described outer ring part 12*a* has, on an upper surface and a lower surface thereof, the base end faces 12*ta*, 12*tb* that abut against the cylinder-abutment faces 13*e*, 13*f* of the ring spacer 13, and the above-described blade part 12*b* is provided with a plurality of radial blades 12*w*, 12*w*, 12*w* . . . . As shown in FIG. 4, the blade 12*w* has a twisted section, and when the rotor 4 having a blade twisted in the direction opposite to the blade 12*w* rotates, it is ensured that the two blades cause gas molecules to move to the exhaust of the pump.

Forward ends of these blades 12*w*, 12*w*, 12*w* . . . are connected to the outer ring part 12*a* and base ends thereof are connected to the inner ring part 12*c*. The outer ring part 12*a* and the inner ring part 12*c* determine the arrangement of each of the blades 12*w* and strongly hold the blades 12*w*, thereby preventing the deformation of the blades 12*w* during the entry of the air. Incidentally, it is not always necessary that the inner ring part 12*c* be provided, although in such an embodiment the holding strength of the blades 12*w* slightly decreases.

Incidentally, in the structure of a vacuum pump of the present invention, the above-described stator blade wheel 12 is formed by combining two semiannular stator blade wheels, which have been cut, into an annular shape. The reason why the annular stator blade wheel 12 is divided into two semiannular stator blade wheels is that the rotor blade wheels 4*a*, 4*a*, . . . , which are disposed in a superimposed manner alternately with the stator blade wheels 12, 12, . . . , are formed integrally with the rotor 4 and hence it is impossible to assemble a pump, with the stator blade wheel 12 kept in an annular condition. Therefore, the stator blade wheel 12 is cut into semiannular stator blade wheels 12H, 12H as shown in FIG. 3, and in the pump assembly process the semiannular stator blade wheels 12H, 12H are inserted opposite to each other between rotor blade wheels 4*a*, 4*a* and then combined into the shape of the annular stator blade wheel 12.

The stator blade wheel 12 is bisected by a cutting width w corresponding to the width of the cutting tool. Cutting the stator blade wheel 12 forms two semiannular stator blade wheels 12H, 12H. When the semiannular stator blade wheels 12H, 12H, from which a portion corresponding to the cutting width w has been cut away, are brought back together (i.e. to face each other), the resulting stator blade wheel 12 does not form a complete annular shape. Therefore, as shown by the alternating long and short dashed lines of FIG. 5, when the stator blade wheel 12 is assembled with the ring spacers 13, 13, the outer circumferential face 12*ac* may sometimes abut against the second inner cylindrical face 13*c* of the ring spacers 13 or conversely, the stator blade wheel 12 may approach the opposite side in the radial direction. In addition, as indicated by the solid lines, the second inner cylindrical face 13*c* and the outer circumferential face 12*ac* may sometimes depart from each other by w. Moreover, the positions of the above-described two members may sometimes be intermediate between the positions of the two cases. That is, the outer ring part 12*a* may sometimes protrude to the rotor blade wheel 4*a* side.

Therefore, when the level difference s between the blade-part end face 12*ya* (12*yb*) of the stator blade wheel and the base end face 12*tb* (12*ta*) is larger than the axis-line direction gap g1 between the rotor blade wheel 4*a* and the stator blade wheel 12 or when the outer ring part 12*a* protrudes into the range of deformation of the rotor blade wheel 4*a* during pump operation even if this level difference s is smaller than g1, there is a possibility that the outer ring part 12*a* may interfere with the rotor blade wheel 4*a*.

Therefore, in the present invention, the level difference s is reduced, whereby the distance h from the base end face 12*ta* (12*tb*) of the outer ring part 12*a* to a supposed plane including the rotor-blade end face 4*aa* (4*ab*) corresponding to the base end face is set at a value larger than the range of deformation of the rotor blade wheel 4*a* during pump operation. If this is done, even in the case where the position of the semiannular stator blade wheel 12H shifts to a leftmost position as shown in FIG. 5 by w, a space corresponding to the height h is ensured between the base end face 12*ta* (12*tb*) and the rotor-blade end face 4*aa* (4*ab*), and the rotor blade wheel 4*a* does not interfere with the outer ring part 12*a* of the stator blade wheel 12*a* even when the rotor blade wheel 4*a* is deformed during pump operation.

From the standpoint of manufacturing the stator blade wheel 12, if the base end face 12*ta* (12*tb*) of the outer ring part 12*a* protrudes from the blade-part end face 12*yb* (12*ya*) of the stator blade wheel, then during the finish machining of the base end face 12*ta* (12*tb*) there is a possibility that the tool may come into contact with the blade 12*w* of the stator blade wheel, and this is undesirable.

However, the present invention is not limited to the example of FIG. 5, and as shown in FIG. 6, the base end face 12*ta* (12*tb*) of the outer ring part 12*a* may be depressed by r compared to the blade-part end face 12*yb* (12*ya*) of the stator blade wheel. In this case, when the base end face 12*ta* (12*tb*) is finish machined, in order to prevent a mounting bed of the stator blade wheel and a tool form coming into contact with the blade 12*w* of the stator blade wheel, a draft clearance should be provided for the blade part 12*b* of the stator blade wheel in the mounting bed or finish machining should be performed so that the tool avoids the blade part 12*b* of the stator blade wheel.

The manufacturing of the stator blade wheel 12 is performed by the steps of FIGS. 7(*a*) to 7(*c*).

First in step (a), a stator-blade-wheel material 12 is formed by precision casting and the like; the stator-blade-wheel material 12 has the shape of a disk, a plurality of radial blades 12*w*, 12*w*, . . . are formed in a blade part 12*b*, an inner ring part 12*c* is formed on the inner side of the blade part 12*b*, and an outer ring part 12*a* is formed on the outer side. In this embodiment, the outer ring part 12*a* is such that the outer ring part 12*a* is thicker than the blade part 12*b* and the inner ring part 12*c*, and a machining allowance for finish machining is provided on both end faces 12*ta*, 12*tb*.

Next in step (b), the stator-blade-wheel material 12 is mounted, with one of the two end faces 12*ta*, 12*tb* applied to a base plane of a mounting bed for base end face finishing (not shown), and the other end face 12*ta* (12*tb*) is finished by lathe turning. The level difference s (see FIG. 5) between the end face 12*ta* (12*tb*) and a blade-part end face 12*yb* (12*ya*) of the stator blade wheel is adjusted to a design value. After that, the stator-blade-wheel material 12 is turned back and with the end face that has become a base end face by finishing applied to the base plane of the mounting bed for base end face finishing, the stator-blade-wheel material 12 is mounted and the other face is similarly finished. The thickness of the outer ring part 12*a* is adjusted to a design value and the level difference s between the two faces is finished to s. Due to machining errors of the above-described step (a), the level difference between the two is not always accurately adjusted. However, this is permissible because small errors are taken into consideration in the value of the above-described distance h. The thickness of the outer ring part 12*a* is adjusted to a design value as precisely as possible, because errors of the thickness of the outer ring part 12*a* accumulate during assembling.

Lastly in step (c), the stator blade wheel 12 is mounted, with one of the base end faces 12*ta* (12*tb*) of the outer ring part 12*a* finished in (b) aligned with a mounting bed for cutting (not shown), and the stator blade wheel 12 is cut into two semiannular stator blade wheels 12H, 12H by using a cutter for cutting. The cutting width w is substantially equal to the width of the cutter for cutting and is larger than a conventional cutting width obtained by use of wire electric discharge machining. In the present invention, however, the distance h, between the base end face 12*ta* (12*tb*) of the outer ring part 12*a* and a supposed corresponding plane including the rotor-blade end face 4*aa* (4*ab*), is set at a value larger than the range of deformation of the rotor blade wheel 4*a* during pump operation. Therefore, even when the semiannular stator blade wheel 12H shifts radially during assembling, the rotor blade wheel 4*a* does not interfere with the outer ring part 12*a* of the stator blade wheel and the pump function is impaired in no way. In addition, the cutting tool is inexpensive, the cutting time is short, and this is very economical.

In step(c) above, in addition to the cutter for cutting, a grinding wheel, such as a diamond wheel, a CBN wheel and a resin bond wheel, may also be used.

The invention claimed is:

1. A vacuum pump, comprising a cylindrical pump case, a rotor rotatably provided within a cylinder of the pump case, a plurality of rotor blade wheels formed in a multi-stage manner on an outer circumference of the rotor, a plurality of stator blade wheels provided within the cylinder of the pump case and arranged alternately with the rotor blade wheels in a multi-stage manner with a prescribed gap from the rotor blade wheels, and a plurality of ring spacers that are provided within the cylinder of the pump case and are each interposed between the stator blade wheels, wherein each of the rotor blade wheels is provided with upper and lower rotor-blade end faces, each of the stator blade wheels consists of a pair of cut-off half-annular stator blade wheels and has a blade part and an outer ring part, the blade part is provided with upper and lower stator-blade end faces, each of which facing to a corresponding one of the rotor-blade end faces, the outer ring part is provided with upper and lower base end faces, each of which abutting against a corresponding one of cylindrical abutment end faces of the ring spacers and having a level difference from a blade-part end face of the stator blade wheel, characterized in that the distance between the base end face of the outer ring part and a supposed plane which includes the rotor-blade end face corresponding to and substantially parallel with the base end face of the outer ring part is set at a value larger than the range of deformation of the rotor blade wheel during pump operation.

2. The turbo-molecular pump according to claim 1, wherein the base end face of the outer ring part projects from the blade-part end face of the stator blade wheel.

3. A method of manufacturing a stator blade wheel of a vacuum pump, comprising a stator-blade-wheel formation step of forming an annular stator blade wheel having a blade part and an outer ring part, a base end face finishing step of forming a base end face on an end face of the outer ring part, and setting the distance between the base end face of the outer ring part and a supposed plane including the rotor-blade end face corresponding to and substantially parallel with the base end face of the outer ring part at a value larger than the range of deformation of the rotor blade wheel during pump operation when the base end face abuts against a cylinder-abutment end face of a ring spacer of a vacuum pump, and a semiannular shape machining/cutting step of cutting off the stator blade wheel, on which the base end face is formed, into a semiannular shape by machining.

* * * * *